United States Patent [19]

Hannecke

[11] 4,336,759

[45] Jun. 29, 1982

[54] ARTICLE DISPLAY STAND

[76] Inventor: Wolf-Dietrich Hannecke, Rischenau Weg 6, 3410 Northeim, Fed. Rep. of Germany

[21] Appl. No.: 821,410

[22] Filed: Aug. 3, 1977

[30] Foreign Application Priority Data

Mar. 3, 1977 [DE] Fed. Rep. of Germany ... 7706489[U]
Mar. 4, 1977 [DE] Fed. Rep. of Germany ... 7706490[U]
Mar. 4, 1977 [DE] Fed. Rep. of Germany ... 7706706[U]

[51] Int. Cl.[3] ..... A47B 57/06

[52] U.S. Cl. ..... 108/144; 108/61; 108/151

[58] Field of Search ..... 108/151, 149, 144, 61, 108/60; 211/133, 126

[56] References Cited

U.S. PATENT DOCUMENTS

| | | | |
|---|---|---|---|
| 221,086 | 10/1879 | Middleton | 108/151 |
| 2,031,162 | 2/1936 | Hoover | 211/133 |
| 2,915,194 | 12/1959 | Shoffner | 108/144 |
| 3,035,708 | 5/1962 | Freeman | 108/144 |
| 3,123,022 | 3/1964 | Huddleston | 108/144 |
| 3,361,508 | 1/1968 | Chassevent | 108/60 |
| 3,501,019 | 3/1970 | Armstrong et al. | 108/61 |
| 3,683,824 | 8/1972 | Weber | 108/151 |
| 3,844,230 | 10/1974 | Hudson et al. | 108/60 |

*Primary Examiner*—Francis K. Zugel

*Attorney, Agent, or Firm*—Michael J. Striker

[57] ABSTRACT

An article display stand has an elongated upright support having a pluraity of recesses which are spaced from one another in the direction of elongation of the support, and an article supporting element mountable on the support in any of a plurality of positions and having a projection which is detachably engageable with the recess of the support. When the projection of the article supporting element engages in the respective recess of the support, the article supporting element is fixed in a respective one of the positions. The recesses may be arranged in rows which are spaced from one another in the circumferential direction of the support, and the article supporting element may have several projections each engageable in the recesses of the respective row. The article supporting element may have a plurality of upright walls extending tangentially relative to a central opening through which the support extends and bounding a plurality of compartments. The two upright walls of each compartment abut against one another. Additional walls may be provided, which are formed as extensions of the above upright walls. The walls may be curved, such as arcuately curved, so that the compartments which are bind by such walls are shaped as spiral segments extending from an outer periphery to an inner region of the article supporting element.

35 Claims, 5 Drawing Figures

ARTICLE DISPLAY STAND

BACKGROUND OF THE INVENTION

The present invention relates to an article display stand, and particularly to an article display stand which has an upright support and an article supporting element mounted on the support.

Article display stands have been proposed in the art for the display of substantially flat consumer goods, such as notebooks, paperbacks, truncated packages, and other packages or goods. Each of such article display stand has a tubular upright support having recesses which are spaced from one another the direction of elongation of the support, that is, in a vertical direction, for a distance corresponding to the height of the goods to be displayed. Article supporting plates are inserted in the thus-formed recesses and therefore are also spaced from one another by the above distance. For a display of the goods or packages, which have different heights, the article supporting plates are provided with supporting walls of different constructions and lengths. The known article display stands have certain disadvantages. Such a display stand has a limitation with respect to a display of the articles of different heights. It is rather expensive. And, finally, to permit articles of different heights to be displayed, different supports and article supporting plates must be produced, which makes this display stand even more expensive.

Further, in the known article display stands inner walls of the article supporting plates are located at a distance from central openings through which the supports extend. Additional walls are located substantially normal to the first-mentioned walls. In this construction the walls form only a limited number of compartments therebetween. An essential part of an upper surface of the article supporting plate is not used. It is very difficult in this case to make the compartments of identical dimensions. A production of the thus-formed compartments of different dimensions and shapes is quite expensive.

Finally, the upright walls of the article supporting elements of the known article display stands are flat. Such walls do not assure a reliable support and holding of such articles which stand vertically in the respective compartments of the display stand. The article such as newspapers, magazines, books and the like, tend to drop from the flat walls under the action of their own weight or of a movement by the buyers. For the above reasons, in the known article display stands either the walls of the article supporting plate must be dimensioned as to hold the articles of the greatest possible anticipated height, or a plurality of article supporting plates must be provided and mounted on the support at the respective distance from one another. Such display stands require essential material expenditures, are difficult to mount, and do not assure a reliable holding and display of the articles, especially of thin articles.

SUMMARY OF THE INVENTION

Accordingly, it is an object of the present invention to provide an article display stand which avoids the disadvantages of the prior art display stands.

More particularly, it is an object of the present invention to provide an article display stand which can be used for the display of articles of different dimensions, and at the same time is of a simple construction, easy to manufacture and assemble, and inexpensive.

Another object of the present invention is to provide an article display stand which can be made with a great number of compartments for articles to be displayed, in which compartments the articles are reliably supported by walls and favorably located for an inspection.

A still further object of the present invention is to provide an article display stand which is convenient in use and has an attractive appearance.

In keeping with these objects, and with others which will become apparent hereinafter, one feature of the present invention, briefly stated, resides in an article display stand which has an elongated support provided with a plurality of recesses which are spaced from and located adjacent to one another in the direction of elongation of the support, and an article supporting element mountable on the support in any of a plurality of positions spaced longitudinally of the support and detachably engageable with the respective ones of the recesses thereof. When the projection of the article supporting element engages in one of the recesses of the support, the article supporting element is fixed in the respective one of the positions.

In such construction a high degree of adjustability of the article display stand is provided with respect to the dimensions of the articles to be displayed. The article supporting element can be displaced in the direction of elongation of the support for any required distance, whether step-by-step or steplessly, and fixed by the interengagement of the projection and the respective recess in an exact position in dependence upon the height of the article to be displayed. The same support and article supporting element may be used for a display of articles which have different heights. The support is easy to manufacture since the recesses thereof may be made in a very simple manner, such as by milling. It is understood that such article display stand is of a simple construction, easy to manufacture, inexpensive and essentially universal with respect to the dimensions of the articles to be displayed thereon.

Another feature of the present invention is that the article supporting element has a plurality of upright walls forming a plurality of compartments and which are located tangential to a central opening of the article supporting element through which the support of the display stand extends. The above walls are inner walls, and each pair of them bounds one of the compartments, so that one wall of the pair abuts against the other wall of this pair. Outer walls are further provided, which bound the compartments from outside and each of which is located parallel to one of the inner walls of the respective compartment.

In such construction the compartments have a trapezoidal shape and are uniformly distributed over the surface of the article supporting element. There is no empty space between the compartments and the central opening of the article supporting element. The number of the walls is greatly reduced as compared with the known display stands, since one wall of one of the compartments is, at the same time, a back wall of an adjacent compartment. The successive and uniform location of the trapezoidal compartments has an attractive appearance and provides for the optimal use of the surface of the article supporting element. The certain order and small number of the walls simplifies the construction and reduces the manufacturing expenditures for the display stand. The construction assures a uniform distribution and favorable display of the articles of different dimensions.

Still another feature of the present invention is that the walls of the article supporting element may be curved, preferably arcuately so as to form a plurality of such compartments which have a shape of spiral segments and are distributed from an outer periphery to a central region of the article supporting element. When the walls are curved, the articles supported by the walls become slightly bent in accordance with the curvature of the walls. The thus bent articles have an improved stiffness and therefore more reliably stand in a vertical position. The height of the walls must be so selected as to only assure the above bending of the articles. In this case it is not necessary to dimension the walls in accordance with the height of the articles or to locate the walls at such a distance from one another which corresponds to the above height. The construction is simple, easy to manufacture, and reliable in use.

A further feature of the present invention is that the recesses of the support may be formed as a continuous helical recess, in which case the article supporting element may be steplessly moved into a required position and fixed in this position. This improves the exactness of the adjustment of the height of location of the articles supporting element.

Still a further feature of the present invention is that the support may be constituted of a resiliently yieldable material. This facilitates a mounting of the article supporting element on the support or an adjustment of the height of location of the former. When the article supporting element must be mounted on the support or displaced in the direction of elongation of the latter, the support is radially compressed so that its diameter is reduced, and then the article supporting element can be unimpededly moved longitudinally of the support.

An additional feature of the present invention is that additional walls may be mounted on a lower surface of the article supporting element, which lower walls are preferably formed as extensions of the respective upper walls. All the walls may be made of one piece with a base plate of the article supporting element. The lower walls may have a height which exceeds the height of the upper walls so that the compartments which are formed by the lower higher walls can be used for a display of articles having a relatively substantial height.

Still additional features of the present invention may be embodied in that the walls may be detachable and removable so as to provide for adjustment of the dimensions of the compartments, in that the base plate and the walls may be transparent so as to improve an inspection of the displayed articles, in that the base plate and the walls of the article supporting member may have rounded corners and margins so as to prevent injuries of the staff and the buyers.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
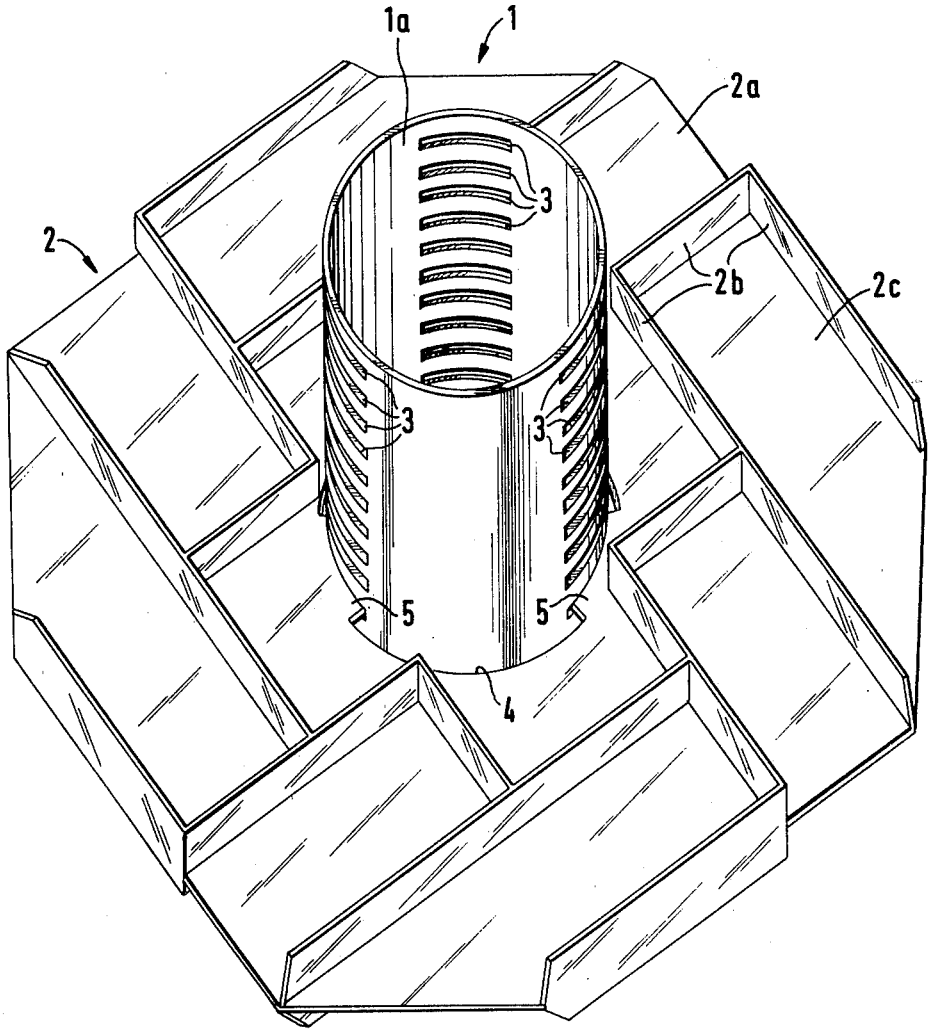
FIG. 1 is a perspective view of an article display stand in accordance with the present invention, including a support which is provided with a plurality of recesses, and an article supporting element mounted on the support.

As shown in the drawing, a display stand in accordance with the present invention has an upright support identified in toto by reference numeral 1, and an article supporting element 2 identified in toto by reference numeral 2.

The support 1 is preferably formed as a tubular member 1*a* of a resiliently yieldable material, such as a plastic material, and has a plurality of recesses. As shown in FIG. 1, the recesses are formed as slots 3 which are arranged in several rows. The rows of the slots 3 are spaced from each other for an identical distance in the circumferential direction of the tubular member 1*a*, whereas the slots 3 of each row are spaced from each other in the direction of elongation of the tubular member 1*a*. The slots 3 of each row are located as close as possible relative to each other and, at the same time, with due regard for the fact that the rigidity of the tubular member 1*a* must not be excessively reduced.

The article supporting element 2 has a base plate 2*a* which has a central opening 4 and projections 5 extending inwardly of the opening. The number, location and dimensions of the projections 5 are so selected that they correspond to the number and the location of the rows of the slots 3 and to the dimensions of the slots 3, so that the projections 5 of the base plate 2*a* of the article supporting element 2 can engage in the respective slots of the tubular member 1*a* of the support 1. A plurality of walls 2*b* are provided on an upper surface of the base plate 2*a*, which walls form a plurality of separate compartments 2*c*. The compartment 2*c* and the wall 2*a* serve for positioning of the articles to be displayed.

For mounting or changing over of the article supporting element 2, the tubular member 1*a* of the support 1 is radially compressed so that its diameter is reduced, and the projections of the base plate 2*a* of the article supporting element 2 are withdrawn from the slots 3 of the tubular member 1*a*. The article supporting member 2 is then moved lengthwise of the thus-deformed tubular member 1*a*, and in a position corresponding to the desirable height of the article supporting element 2, the projections 5 of the base plate 2*a* engage in the respective slots 3 of the tubular member 1*a* of the support 1.

Figure 2:
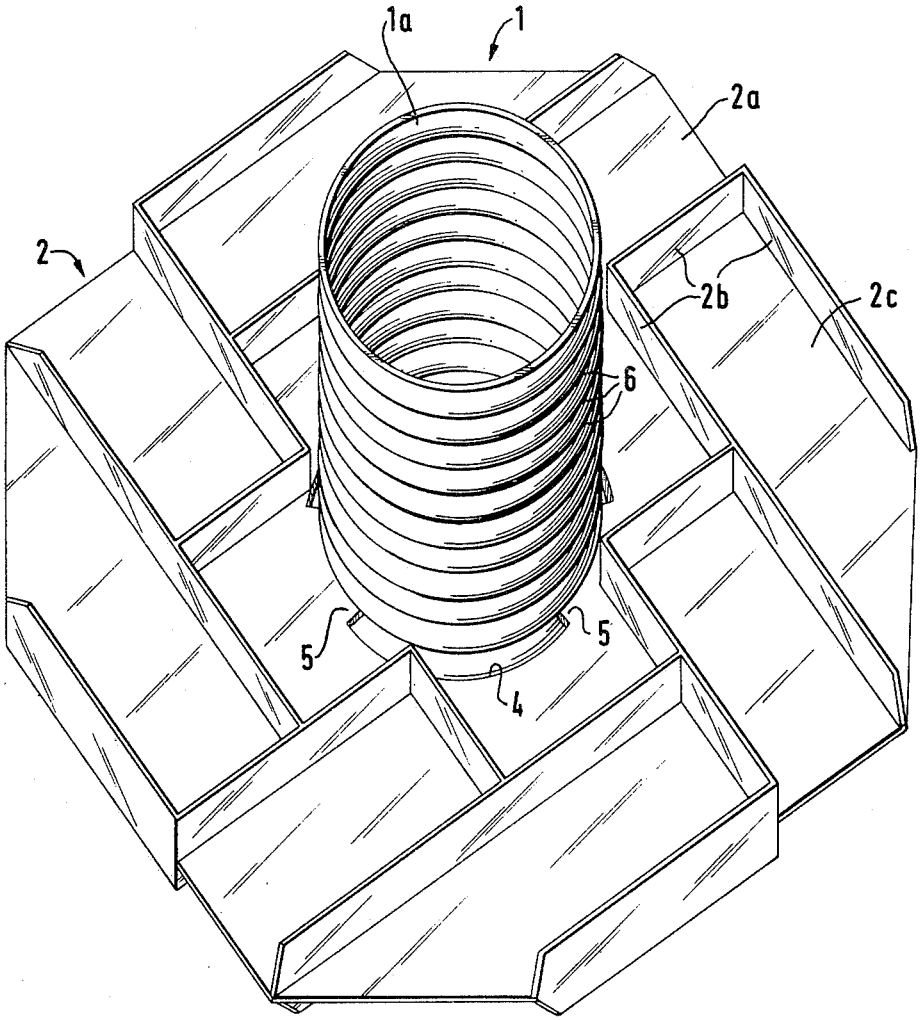
FIG. 2 is a perspective view of an article display stand in accordance with another embodiment of the present invention, including a support which has a helical recess.

FIG. 2 illustrates another embodiment of the present invention. The parts of the article display stand shown in this Figure and also in subsequent Figures, which are identical to the parts shown in FIG. 1 are identified with identical reference numerals. In accordance with this embodiment, the recesses of the tubular member 1*a* of the support 1 are formed as a continuous helical groove 6 in which the projections 5 of the base plate 2*a* of the article supporting element 2 can engage. By movement of the projections 5 of the article supporting element 2 lengthwise of the helical groove 6 of the support 1 the former can be steplessly adjusted so as to be positioned at any desirable height. When it is necessary to substantially displace the article supporting element 2 relative to a former position thereof, the resiliently yieldable support 1 can be again radially compressed so that its diameter is reduced, the projections 5 of the base plate 2*a* of the article supporting element 2 are disengaged from the helical groove 6, and then the article supporting element 2 can be moved for any desirable distance in the direction of elongation of the support without rotation of the former along intermediate convolutions of the helical groove 6.

Figure 3:
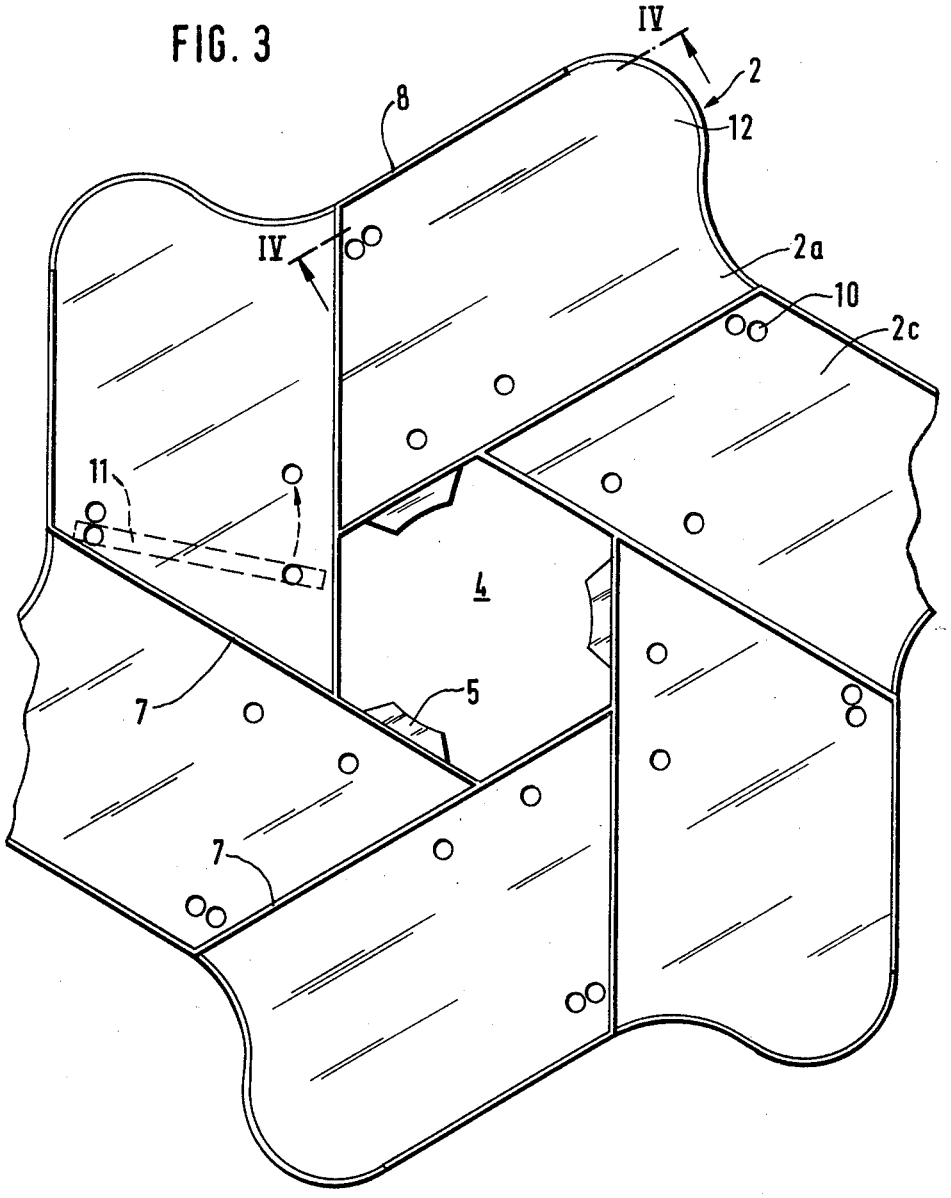
FIG. 3 is a plan view of an article supporting element of an article display stand in accordance with a further embodiment of the present invention, which article supporting element has a plurality of specifically located walls bounding a plurality of compartments.
Figure 4:
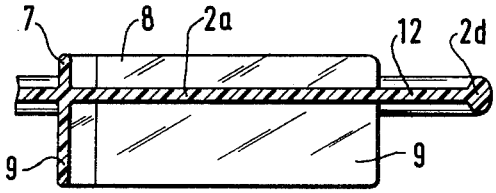
FIG. 4 is a section taken on the line IV—IV of FIG. 3.

FIGS. 3 and 4 show an article display stand in accordance with a further embodiment of the present invention. The support 1 is here omitted for the sake of clarity. The article supporting element 2 has a plurality of compartments each of which is formed by two inner walls 7 mounted on an upper surface of the base plate 2*a* of the article supporting element 2. Each of the inner walls 7 separates each individual compartment 2*c*′ from an adjacent compartment located at the respective side of this individual compartment. As clearly shown in FIG. 4, each of the inner walls 7 extends tangentially relative to the central opening 4 of the base plate 2*a*. Moreover, one of the inner walls 7 of each compartment 2*c* extends up to the other wall 7 of the same compartment. The above two walls 7 of each of the compartments 2*c* preferably meet each other at an acute angle. In such construction, the inner wall 7 of one compartment 2*c* is at the same time a backwall of a preceding compartment.

As shown in the drawing, the compartments 2*c* are spaced from each other in the circumferential direction of the base plate 2*a* of the article supporting member 2.

A plurality of outer walls 8 is further provided, also mounted on the upper surface of the base plate 2*a* of the article supporting member 2. Each of the outer walls 8 of each compartment 2*c* is spaced from one of the inner walls 7 of the same compartment at a distance equal to the width of this compartment, and is located parallel to this one inner wall. The thus-arranged inner and outer walls together form the approximately trapezoidal compartments. At the same time, the thus-formed compartments are of an identical shape and are uniformly distributed over the upper surface of the article supporting element 2.

A plurality of further walls 9 are provided, mounted on a lower surface of the base plate 2*a* of the article supporting element 2. Each of the walls 9 is formed as an extension of a respective one of the upper walls 7 and 8. For the sake of simplicity only one such lower wall 9 is shown in FIG. 4. The lower walls 9 have a height which exceeds the height of the upper walls 7 and 8. The thus-formed lower walls 9 of the article supporting element 2 perform very specific functions. When the articles to be displayed have a great height or must be positioned one on another, the lower wall can be used for display of such articles.

As shown in FIG. 3, the base plate 2*a* in the region of each compartment has holes 10 for detachably fastening additional walls 11 to the base plate, one of which additional walls is shown in dotted lines. The additional walls 11 serve for an adjustment of the dimension of each of the compartments 2*c*. For these purposes several holes 10 are provided, which are so interspersed over the surface of the respective compartment that the additional wall 11 can be located in different positions and thereby can bound different spaces within each compartment.

The base plate 2*a* in the regions of the inlets of the compartments 2*c* has projecting portions 12, each of which is formed with a rounded outer margin. This excludes the danger of injury to the staff and the buyers. The outer margins of the above projecting portions 12 may also be provided with flanges 2*d* which extend downwardly and/or upwardly with respect to the base plate 2*a* and improve the appearance of the display stand. At the same time the flanges prevent an accidental drop out of the articles outwardly from the compartments.

The base plate 2*a*, as well as the walls 7, 8 and 9, may be constituted of a transparent material for the purpose of improvement of a visibility of a large area of the display stand. These parts of the display stand may be slightly tinted so that dust which tends to settle thereon is less visible. The upper surface of the base plate 2*a*, as well as the walls, may be formed with a structure so as to roughen the surface or to improve the appearance thereof. The outer margins and corners of the base plate 2*a* and the walls 7, 8 and 9 are rounded for the same purpose of preventing injuries to the staff and the buyers.

Figure 5:
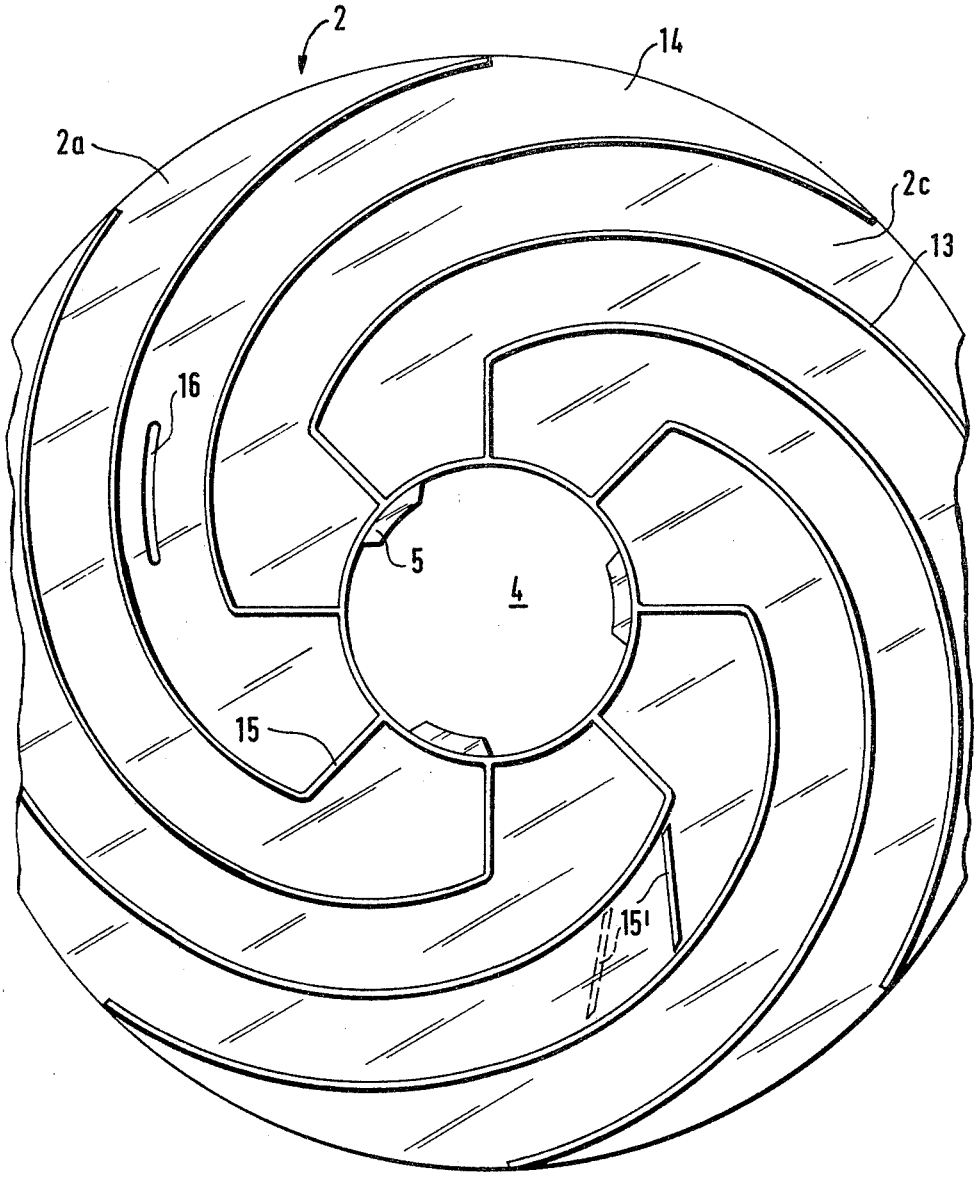
FIG. 5 is a plan view of an article supporting element of an article display stand in accordance with still a further embodiment of the present invention, which article supporting element has a plurality of arcuately curved walls bounding a plurality of segmentally shaped compartments.

FIG. 5 shows an article display stand in accordance with still a further embodiment of the present invention. In this embodiment the base plate 2 of the article supporting element 2 is circular. The support is also not shown in this Figure for the sake of clarity. The article supporting element 2 has a plurality of the walls 13 located on the upper surface of the base plate 2*a* and forming a plurality of compartments 2*c*. As clearly shown in this Figure of the drawing, the walls 13 are curved in the direction towards inlets 14 of the respective compartments. Preferably, the walls are arcuately curved and uniformly distributed over the upper surface of the base plate 2*a*. In this case, the compartments are formed as spiral segments which are successively distributed from an outer margin up to the inner margin of the base plate 2*a*. Various articles such as prospectuses and the like may be located in the compartments 2*c* and supported by the walls 13.

Similarly to the display stand which is shown in FIGS. 3 and 4, the display stand in accordance with the present embodiment may have lower walls formed as extensions of the walls 13, may be made of a transparent material, may have rounded corners and margins, and the like.

The base plate 2*a* in the region located within the compartments 2*c* may be provided with grooves or slots 16 which preferably extend in a direction corresponding to the curvature of the walls 13. These grooves or slots serve for insertion thereinto of lower marginal sections of the articles to be displayed so that the articles are not only supported by the walls 13, but are also retained by the grooves or slots 16 from below. Only one of the slots or grooves is partially shown in the drawing for the sake of simplicity.

Walls 15 are further mounted on the base plate 2*a* in the region of the central opening 4 of the latter. Inner ends of the curved walls 13 which are inwardly spaced from outer ends thereof, extend up to the respective walls 5 so that the compartments 2c have pocket-shaped inner portions. The thus-arranged walls 13 and 15 make the entire upper and lower surface of the base plate 2a suitable for the display of the articles.

In order to adjust the dimensions of the compartments in dependence upon the dimensions of articles to be displayed, the walls 15 may be mounted detachably on and displaceably relative to the base plate 2a. For these purposes the base plate may be provided with slots in which the walls 15 may be inserted. Such displaceable wall is shown in FIG. 5 in dotted lines and identified by reference numeral 15'.

In the drawing the wall 15' is shown as being straight. It is advantageous if this wall 15' is constituted of a resiliently yieldable material and can be bent in accordance with the curvature of the adjacent curved wall 13. In this case, when an article must be inserted in the inner portion of the compartment 2c, the wall 15' is bent off from its transverse position so as to fit on the adjacent curved wall 13. The compartment is then free for an insertion of the article in the inner portion thereof. After the article is inserted in the inner portion of the compartment, the resiliently yieldable wall 15' is unbent and occupies its former position, that is, it closes the inner portion of the compartment from outside.

It will be understood that each of the elements described above, or two or more together, may also find a useful application in other types of constructions differing from the types described above.

While the invention has been illustrated and described as embodied in a display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An article display stand, comprising an elongated upright support extending in a first direction and having a plurality of recesses which are spaced from and located adjacent to each other in said first direction; and an article supporting element mountable in said support in any of a plurality of positions spaced longitudinally of said support, said article supporting element having a base plate which extends in a second direction transverse to said first direction and is provided with a central opening through which said support extends so that said support is located inwardly of said article supporting element and the latter is located outwardly of said support, said base plate having a projection which projects in said second direction inwardly of said opening and is detachably engageable with respective ones of said recesses so that, when said projection of said base plate of said article supporting element engages in one of said recesses of said support, said article supporting element is fixed in a respective one of said positions, said inwardly located support being resiliently deformable in said second direction so that said inwardly located support is deformed inwardly in said second direction in response to displacement of said article supporting element over said support in said first direction whereby said article supporting element can be displaced from one to another of said positions.

2. The article display stand as defined in claim 1, wherein said support is tubular.

3. The article display stand as defined in claim 1, wherein said recesses are distributed along the entire length of said support.

4. The article display stand as defined in claim 1, wherein said support has another such plurality of recesses spaced from said first mentioned plurality in the circumferential direction of said support, said article supporting element having another such projection engaging with respective ones of the recesses of said other plurality.

5. The article display stand as defined in claim 2, wherein said recesses are through slots extending through a wall of a tubular support.

6. The article display stand as defined in claim 1, wherein said recesses are indentations formed in an outer surface of said support.

7. The article display stand as defined in claim 6, wherein said indentations are groove-shaped.

8. The article display stand as defined in claim 6, wherein said indentations together form a substantially helical groove.

9. The article display stand defined in claim 8, wherein said helical groove is a continuous groove.

10. The article display stand as defined in claim 1, wherein said support is constituted of a resiliently yieldable material.

11. The article display stand as defined in claim 1, wherein said article supporting element has a plurality of substantially upright inner walls located on an upper surface of said base plate and forming a plurality of compartments arranged for accommodating articles, each of said compartments being at least partially formed by two of said inner walls each of which separates said compartments from a respective adjacent compartment, said inner walls being located tangential relative to said central opening of said article supporting element and extending up to said central opening.

12. The article display stand as defined in claim 11, wherein one of said inner walls which separates one of said compartments from one adjacent compartment extends up to the other inner wall which separates said one compartment from the other adjacent compartment.

13. The article display stand as defined in claim 11, wherein said compartments are spaced from each other in the circumferential direction of said article supporting element.

14. The article display stand as defined in claim 11, wherein article supporting element has a plurality of walls which form outer wall of each of said compartments, the outer wall of each compartment being spaced from one of the inner walls of the same compartment at a distance equal to the width of the latter and being located substantially parallel to said one inner wall.

15. The article display stand as defined in claim 14, and further comprising a plurality of walls located on a lower surface of said base plate of said article supporting element and each being an extension of a respective one of said inner and outer walls, said lower walls bounding a plurality of further compartments arranged for accommodating articles.

16. The article display stand as defined in claim 15, wherein each of said lower walls has a height exceeding the height of the respective one of said inner and outer walls so that in said further compartments such articles can be accommodated which have a height exceeding the height of articles accommodated in said first-mentioned compartments.

17. The article display stand as defined in claim 15, wherein said article supporting element has an additional wall in each of said compartments and means for detachably mounting said additional wall therein, said additional wall and said means being located adjacent to said opening of said base plate of said article supporting element.

18. The article display stand as defined in claim 17, wherein said mounting means includes a through bore formed in said base plate and adapted for receiving a fastening element for mounting said additional wall on said base plate.

19. The article display stand as defined in claim 15, wherein said walls are constituted of an at least translucent material.

20. The article display stand as defined in claim 17, wherein said base plate of said article supporting element has side marginal sections and corners, said walls having side marginal sections and corners, the side marginal sections and the corners of said base plate and said walls being rounded.

21. The article display stand as defined in claim 14, wherein one of said inner walls and one of said outer walls together bound an outer peripheral opening of one of said compartments, said base plate of said article supporting element having a section which is located adjacent to said outer peripheral opening of said one compartment and is provided with a flange extending beyond at least one of face surfaces of said base plate.

22. The article display stand as defined in claim 14, wherein said flange extends beyond an upper and a lower face surface of said base plate.

23. The article display stand as defined in claim 14, wherein one of said inner walls and one of said outer walls together bound an outer peripheral opening of said one compartment, said base plate having a section which is located adjacent to said outer peripheral opening of said one compartment and provided with a substantially flat projection which has a rounded outer margin.

24. The article display stand as defined in claim 1, wherein said article supporting element has a plurality of substantially upright walls located on an upper surface of said base plate of said article supporting element and forming a plurality of compartments, each of which has an outer opening, the walls bounding each of said compartments having portions which are curved in the direction towards said outer opening of the respective compartment.

25. The article display stand as defined in claim 24, wherein said curved portions of said walls are arcuate.

26. The article display stand as defined in claim 25, wherein said curved portions of said walls are spaced from one another for a substantially equal distance.

27. The article display stand as defined in claim 25, wherein said curved portions of said walls are substantially uniformly distributed over the upper surface of said base plate so that the compartments which are bound thereby have a form of spiral segments spaced from each other in the direction from an outer to an inner portion of said base plate.

28. The article display stand as defined in claim 27, wherein each of said walls has a further portion located adjacent to said central opening of said base plate, the curved portion of each of said walls having an outer end located adjacent to an outer periphery of said base plate and an inner end spaced from said outer end in the direction of elongation of the respective curved portion, the inner end of the curved portion of each of said walls extending up to the further portion of the respective wall.

29. The article display stand as defined in claim 15, wherein said upper walls and said lower walls are formed of one piece with said base plate of said article supporting element.

30. The article display stand as defined in claim 15, wherein said base plate further has a plurality of recesses each located in one of said compartments between the adjacent curved portions of said walls which bound the respective compartment, said recesses extending in a direction corresponding to the curvature of said adjacent curved portions of said walls.

31. The article display stand as defined in claim 28, wherein said further portions of said walls are detachably and displaceably mounted on said base plate.

32. The article display stand as defined in claim 25, wherein said article supporting element further has additional walls each located in the respective compartment and operative for at least partially closing the same, said additional walls being detachable and displaceably mounted on said base plate.

33. The article display stand as defined in claim 32, wherein each of said additional walls is resiliently yieldable between a first position in which it extends substantially transversely to said curved walls and thereby closes the respective compartment, and a second position in which said additional wall is bent off from said first position and fits on a respective curved wall so as to open said compartment.

34. An article display stand as defined in claim 1, wherein said projection of said base plate of said article supporting element also extends in said second direction in which the remainder of said base plate extends.

35. An article display stand, comprising an elongated resiliently deformable upright support having a plurality of recesses which are spaced from and located adjacent to each other in the direction of elongation of said support; and an article supporting element mountable in said support in any of a plurality of positions spaced longitudinally of said support, said article supporting element having a base plate provided with a central opening through which said support extends and a projection which projects inwardly of said openings and is detachably engageable with respective ones of said recesses so that, when said projection of said support element engages in one of said recesses of said support, said article supporting element is fixed in a respective one of said positions, said article supporting element having a plurality of substantially upright inner walls located on an upper surface of said base plate and forming a plurality of compartments, each of said compartments being at least partially formed by two of said inner walls each of which separates said compartment from a respective adjacent compartment, said inner walls being located tangential relative to said central opening of said article supporting element and extending up to said central opening.

* * * * *

UNITED STATES PATENT AND TRADEMARK OFFICE

CERTIFICATE OF CORRECTION

PATENT NO. :4,336,759

DATED : June 29, 1982

INVENTOR(S) : Wolf-Dietrich Hannecke

It is certified that error appears in the above-identified patent and that said Letters Patent are hereby corrected as shown below:

In the heading [30] the filing date of the second listed German application 7706490[U] should read -- Mar. 3, 1977 --.

Signed and Sealed this

*Twenty-first* Day of *September 1982*

[SEAL]

*Attest:*

GERALD J. MOSSINGHOFF

*Attesting Officer*

*Commissioner of Patents and Trademarks*